US010784008B2

(12) United States Patent
Zhang et al.

(10) Patent No.: US 10,784,008 B2
(45) Date of Patent: Sep. 22, 2020

(54) SHIELD COVER FOR RADIATION SOURCE MACHINE AND SECURITY INSPECTION APPARATUS

(71) Applicants: Nuctech Company Limited, Beijing (CN); Tsinghua University, Beijing (CN)

(72) Inventors: Long Zhang, Beijing (CN); Li Zhang, Beijing (CN); Mingzhi Hong, Beijing (CN); Jinning Liang, Beijing (CN)

(73) Assignees: Nuctech Company Limited, Beijing (CN); Tsinghua University, Beijing (CN)

( * ) Notice: Subject to any disclaimer, the term of this patent is extended or adjusted under 35 U.S.C. 154(b) by 48 days.

(21) Appl. No.: 16/166,136

(22) Filed: Oct. 21, 2018

(65) Prior Publication Data

US 2019/0122777 A1 Apr. 25, 2019

(30) Foreign Application Priority Data

Oct. 25, 2017 (CN) ..... 2017 1 1008514

(51) Int. Cl.
*G21F 5/02* (2006.01)
*H05G 1/04* (2006.01)
*G21F 3/00* (2006.01)

(52) U.S. Cl.
CPC ..... *G21F 5/02* (2013.01); *G21F 3/00* (2013.01); *H05G 1/04* (2013.01)

(58) Field of Classification Search
CPC ..... G21F 3/00; G21F 5/02; H05G 1/04
(Continued)

(56) References Cited

U.S. PATENT DOCUMENTS 3,844,018 A * 10/1974 Calhoun ..... G21G 4/06 29/407.06
5,384,821 A 1/1995 Jedlitschka et al.
(Continued)

FOREIGN PATENT DOCUMENTS

EP 2869672 A1 5/2015
JP 2002-257751 A 9/2002
(Continued)

OTHER PUBLICATIONS

"European Application Serial No. 18198409.7, extended European Search Repeat dated Mar. 21, 2019", 5 pgs.
(Continued)

*Primary Examiner* — Taeho Jo
(74) *Attorney, Agent, or Firm* — Schwegman Lundberg & Woessner, P.A.

(57) ABSTRACT

The present disclosure relates to a shield cover for a radiation source machine and a security inspection apparatus. The shield cover for a radiation source machine comprises: a frame body provided with a receiving chamber for receiving the radiation source machine, an end opening and an ray exit through which rays are emitted out from the radiation source machine; an end cover disposed at the end opening of the frame body and provided with a sealed chamber communicating with the receiving chamber; and a connecting member disposed between the end cover and the frame body and provided with an opening for communicating the sealed chamber of the end cover with the receiving chamber of the frame body, and the end cover being movably connected to the frame body by the connecting member such that a distance of the end cover from the end opening of the frame body is adjustable.

20 Claims, 9 Drawing Sheets

(58) Field of Classification Search
USPC ..... 378/140
See application file for complete search history.

(56) References Cited

U.S. PATENT DOCUMENTS

| | | | | |
|---|---|---|---|---|
| 7,330,534 | B2 * | 2/2008 | Li | G21K 1/025 378/145 |
| 2006/0008057 | A1 * | 1/2006 | Daniel | H05G 1/04 378/203 |
| 2007/0147581 | A1 * | 6/2007 | Ellenbogen | G01V 5/005 378/19 |
| 2008/0043919 | A1 * | 2/2008 | Chapin | H05G 1/025 378/119 |
| 2009/0052626 | A1 * | 2/2009 | Inazuru | H01J 35/18 378/140 |
| 2009/0268873 | A1 * | 10/2009 | Inazuru | H01J 35/16 378/140 |
| 2012/0121065 | A1 * | 5/2012 | Rogers | H01J 35/16 378/51 |
| 2014/0050305 | A1 * | 2/2014 | Zhao | H05G 1/08 378/141 |
| 2014/0211923 | A1 * | 7/2014 | Chen | H01J 35/16 378/105 |
| 2015/0063548 | A1 * | 3/2015 | Kosugi | H01J 35/045 378/140 |
| 2015/0124936 | A1 * | 5/2015 | Anno | A61B 6/4488 378/130 |

FOREIGN PATENT DOCUMENTS

| | | | |
|---|---|---|---|
| JP | 2009-258117 | A | 11/2009 |
| JP | 2015-032512 | A | 2/2015 |
| RU | 2185641 | C1 | 7/2002 |
| RU | 66576 | U1 | 9/2007 |
| WO | WO-2006/074431 | A2 | 7/2006 |

OTHER PUBLICATIONS

"Russian Application Serial No. 2018136440/07(060276), Decision to Grant a Patent dated Apr. 22, 2019", (w/ English Translation), 21 pgs.

* cited by examiner

A-A

B

SHIELD COVER FOR RADIATION SOURCE MACHINE AND SECURITY INSPECTION APPARATUS

CROSS REFERENCE

The present application claims a priority of the Chinese Application No. 201711008514.1, filed on Oct. 25, 2017, the entire of which is incorporated here by reference.

TECHNICAL FIELD

The present disclosure relates to a field of radiation detecting technology, particularly to a shield cover for a radiation source machine and a security inspection apparatus.

BACKGROUND

A radiation source machine is mainly used for irradiating an object under detection by a beam of rays generated by a ray tube, so that the rays hit a detector after absorption by the object under detection. The detector converts the rays into a signal, and the signal is amplified and processed to be displayed on a display screen, which can assist an inspector to distinguish different substances simply and quickly.

During the use of the radiation source machine, as a radiation surface for emitting the rays of the ray tube is large, the detector cannot receive all of the rays, and thus there are radiation rays which fails to be used for acting on the object under detection. Due to a large radiation of X-rays, if the X-rays that cannot be received by the detector or are not used is not shielded after emitted, unnecessary damage to the human body will occur.

SUMMARY

Embodiments of the present disclosure provide a shield cover for a radiation source machine and a security inspection apparatus, which can effectively shield useless rays generated by the radiation source machine, thereby avoiding damage to the human body without damaging the radiation source machine itself.

An aspect of an embodiment of the present disclosure provides a shield cover for a radiation source machine, comprising: a frame body provided with a receiving chamber for receiving the radiation source machine, an end opening and an ray exit through which rays are emitted out from the radiation source machine; an end cover disposed at the end opening of the frame body and provided with a sealed chamber communicating with the receiving chamber; and a connecting member disposed between the end cover and the frame body and provided with an opening for communicating the sealed chamber of the end cover with the receiving chamber of the frame body, and the end cover being movably connected to the frame body by the connecting member such that a distance of the end cover from the end opening of the frame body is adjustable.

According to one embodiment of the present disclosure, the connecting member comprises a first connecting member and a second connecting member, a side of the first connecting member is fixedly connected to the end cover and the other side of the first connecting member is movably connected to the frame body, and a side of the second connecting member is fixedly connected to the end cover and the other side of the second connecting member is movably connected to the frame body, wherein the first connecting member and the second connecting member are arranged to mate with each other to form the opening.

According to one embodiment of the present disclosure, the first connecting member and the frame body are respectively provided with a first hole and a second hole corresponding with each other, wherein at least one of the first hole and the second hole is formed into a strip-shaped hole, and a first connector is disposed within the first hole and the second hole to movably connect the first connecting member to the frame body, and the second connecting member and the frame body are respectively provided with a third hole and a fourth hole corresponding with each other, wherein at least one of the third hole and the fourth hole is formed into a strip-shaped hole, and a second connector is disposed within the third hole and the fourth hole to movably connect the second connecting member to the frame body.

According to one embodiment of the present disclosure, the connecting member is provided with an enclosing member surrounding the opening and extending into the receiving chamber, and an outer wall surface of the enclosing member and an inner wall surface of the receiving chamber are kept overlapping with each other with a gap remained therebetween.

According to one embodiment of the present disclosure, the frame body, the end cover, and the enclosing member are provided with anti-radiation plates on their respective wall surfaces.

According to one embodiment of the present disclosure, the anti-radiation plates are provided on respective inner wall surfaces of the frame body, the end cover and the enclosing member, and two adjacent ends of two adjacent anti-radiation plates are in an overlapping connection with each other.

According to one embodiment of the present disclosure, one of the two adjacent ends is formed with a stepped portion, and the other of the two adjacent ends is formed to mate with the stepped portion such that the two adjacent ends are in the overlapping connection with each other.

According to one embodiment of the present disclosure, the frame body is formed into a separated structure and includes a top cover and a bottom cover in connection with each other.

According to one embodiment of the present disclosure, the end cover is provided with an auxiliary positioning member, an end of which is formed to extend into the sealed chamber so as to be capable of abutting the radiation source machine and limiting a horizontal play of the radiation source machine.

According to one embodiment of the present disclosure, the auxiliary positioning member is formed as a rod threadedly connected to the end cover.

The shield cover for a radiation source machine according to the embodiments of the present disclosure includes the frame body, the end cover body and the connecting member. The receiving chamber, the end opening and the ray exit are provided on the frame body. The end cover is movably connected at the end opening of the frame body by the connecting member. The radiation source machine is received in the receiving chamber of the frame body, with two ends extending into the corresponding sealed chambers of the end cover through the opening of the connecting member. The rays emitted by the radiation source machine can emit out only through the ray exit on the frame body to detect the object under detection, and the remaining rays are shielded by the shield cover for a radiation source machine to avoid the human body from being damaged. Meanwhile, by changing a relative position of the end cover to the frame body, a distance of the end cover from the end opening can be changed, so that the inner end surface of the end cover can just lie against the end surface of the radiation source machine, to limit a position of the radiation source machine, meeting a detection requirement for an object under detection without damaging the radiation source machine itself.

Another aspect of an embodiment of the present disclosure provides a security inspection apparatus, comprising: the shield cover for a radiation source machine as described above; a radiation source machine disposed in the receiving chamber; a U-shaped arm provided on an outside of the frame body and connected to the radiation source machine to make the radiation source machine in a suspended state in the receiving chamber.

According to an embodiment of the present disclosure, the U-shaped arm is engaged with the frame body with the frame body received in an U-shaped opening of the U-shaped arm, and the frame body is provided with a fixing seat at a position corresponding to the U-shaped arm, through which the U-shaped arm is connected to the frame body, wherein an adjusting pad is provided between a bottom of the U-shaped arm and the fixing seat

BRIEF DESCRIPTION OF THE DRAWINGS

Features, advantages, and technical effects of exemplary embodiments of the present disclosure will be described below with reference to the accompanying drawings.

Figure 1:
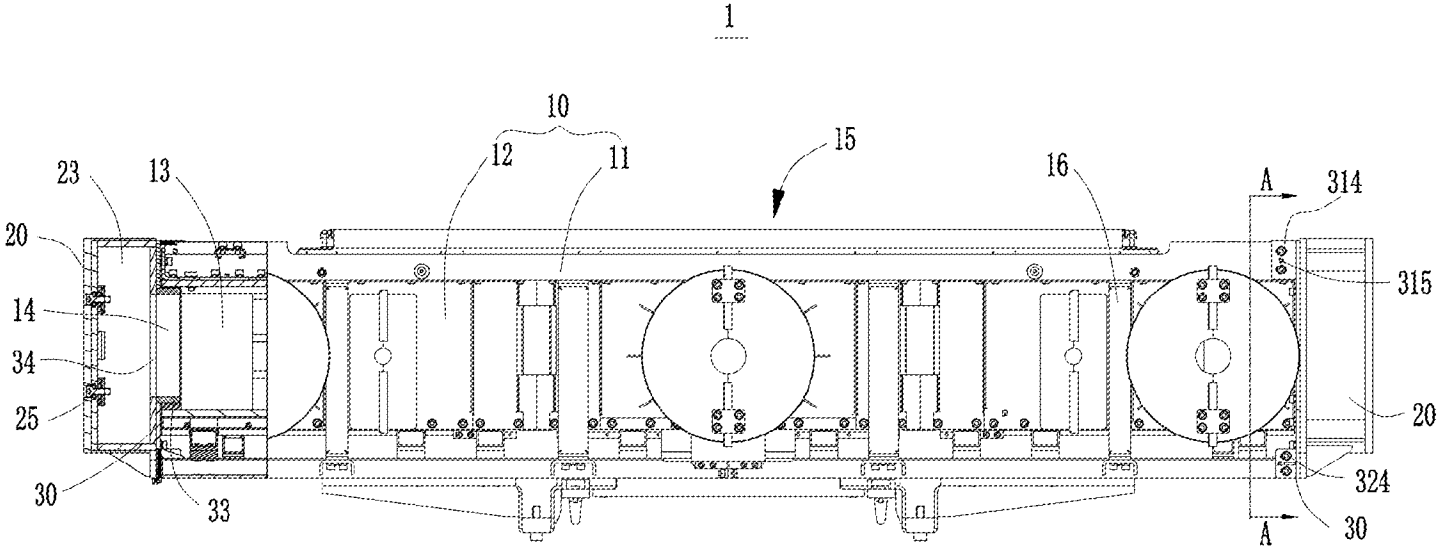
FIG. 1 is a front view showing a structure of a shield cover for a radiation source machine according to an embodiment of the present disclosure.

Wherein:

1—Shield cover for radiation source machine;

10—Frame body; 11—Top cover; 12—Bottom cover; 13—Receiving chamber; 14—End opening; 15—Ray exit; 16—Reinforced beam;

121—Main shielding body; 121*a*—Bottom plate; 121*b*—Side plate; 121*c*—Upper opening; 121*d*—Side opening;

122—Auxiliary shielding body; 123—Second hole; 124—Fourth hole;

20—End cover; 21—End plate; 22—Annular side plate; 23—Sealed chamber; 24—Through hole; 25—Auxiliary positioning member; 26—Reinforced rib;

30—Connecting member; 31—First connecting member; 32—Second connecting member; 33—Enclosing member; 34—Opening;

311—First mounting plate; 312—First connecting tab; 313—First hole; 314—Connector; 315—Positioning pin;

321—Second mounting plate; 322—Second connecting tab; 323—Third hole; 324—Connector;

40—Anti-radiation plate; 41—Stepped portion

2—U-shaped arm; 3—Connecting component; 4—Fixing seat;

410—Frame body connecting end; 420—U-shaped arm connecting end; 421—U-shaped groove; 422—Adjusting pad.

DETAILED DESCRIPTION

Features and exemplary embodiments of various aspects of the present disclosure will be described in detail below. In the following detailed description, numerous specific details are set forth to provide a thorough understanding of the present disclosure. It will be apparent to the person skilled in the art, however, that the present disclosure may be practiced without some of these details. The following description of embodiments is merely for providing a better understanding of the invention by providing examples of the present disclosure. In the drawings and the following description, at least some of known structures and techniques are not shown in order to avoid unnecessary obscuring of the present disclosure. For clarity, dimensions of some of structures may be exaggerated. Features, structures, or characteristics described below may be combined in any suitable manner in one or more embodiments. Further, terms "first", "second", "third", etc. are used for descriptive purposes only and cannot be understood as indicating or implying relative importance.

Words indicating orientation appearing in the following description are all directions shown in the drawings, and are not intended to limit the specific structure of the shied cover for a radiation source machine of the present disclosure. In the description of the present disclosure, it should be noted that terms "installation" and "connection" are to be understood broadly, and may be, for example, a fixed connection or a detachable connection, or an integral connection; they can be a direct or indirect connection. The specific meaning of the above terms in the present disclosure can be understood by the person skilled in the art depending on specific cases.

For a better understanding of the present disclosure, a shield cover for a radiation source machine 1 according to embodiments of the present disclosure will be described in detail below with reference to FIG. 1 to FIG. 10.

As shown in FIG. 1, an embodiment of the present disclosure provides a shield cover for a radiation source machine 1 including a frame body 10, an end cover 20 and a connecting member 30. The frame body 10 is formed with a receiving chamber 13, an end opening 14 and a ray exit 15. The receiving chamber 13 is used for receiving the radiation source machine. The ray exit 15 is used for rays emitted out from the radiation source machine through it. The end cover 20 is disposed at the end opening 14 and is formed with a sealed chamber 23 communicating with the receiving chamber 13. The connecting member 30 is disposed between the end cover 20 and the frame body 10 and is formed with an opening 34 for communicating the sealed chamber 23 with the receiving chamber 13. The end cover 20 is movably connected to the frame body 10 by the connecting member 30 such that a distance of the end cover 20 from the end opening 14 is adjustable.

Figure 2:
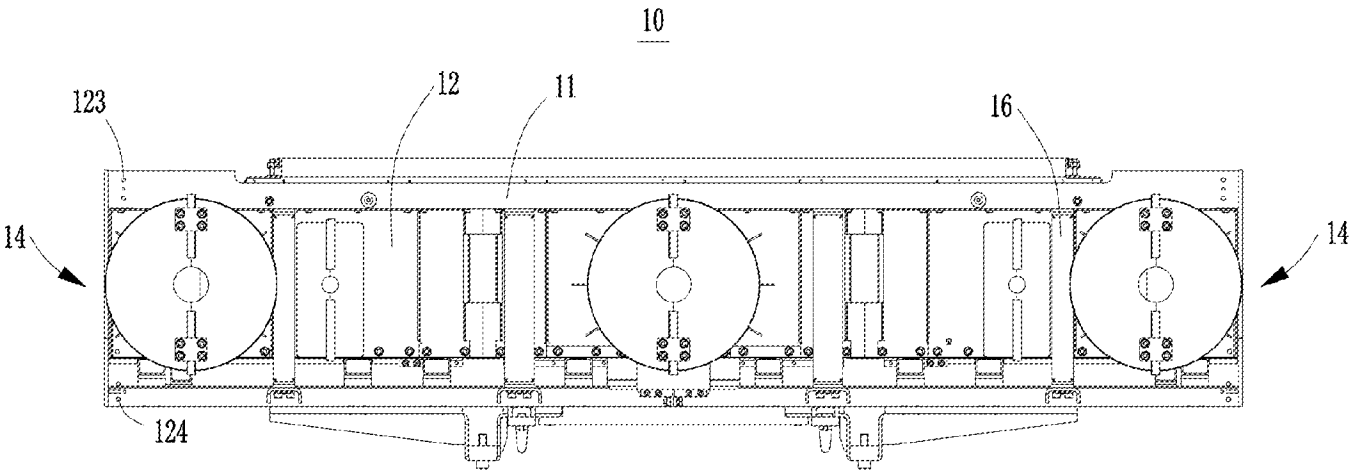
FIG. 2 is a schematic view showing an overall structure of a frame body according to an embodiment of the present disclosure.

Specifically, as shown in FIG. 2, the frame body 10 is formed into a separated structure, and includes a top cover 11 and a bottom cover 12 connected with each other. The frame body 10 with the separated structure facilitates installation of the radiation source machine.

Figure 3:
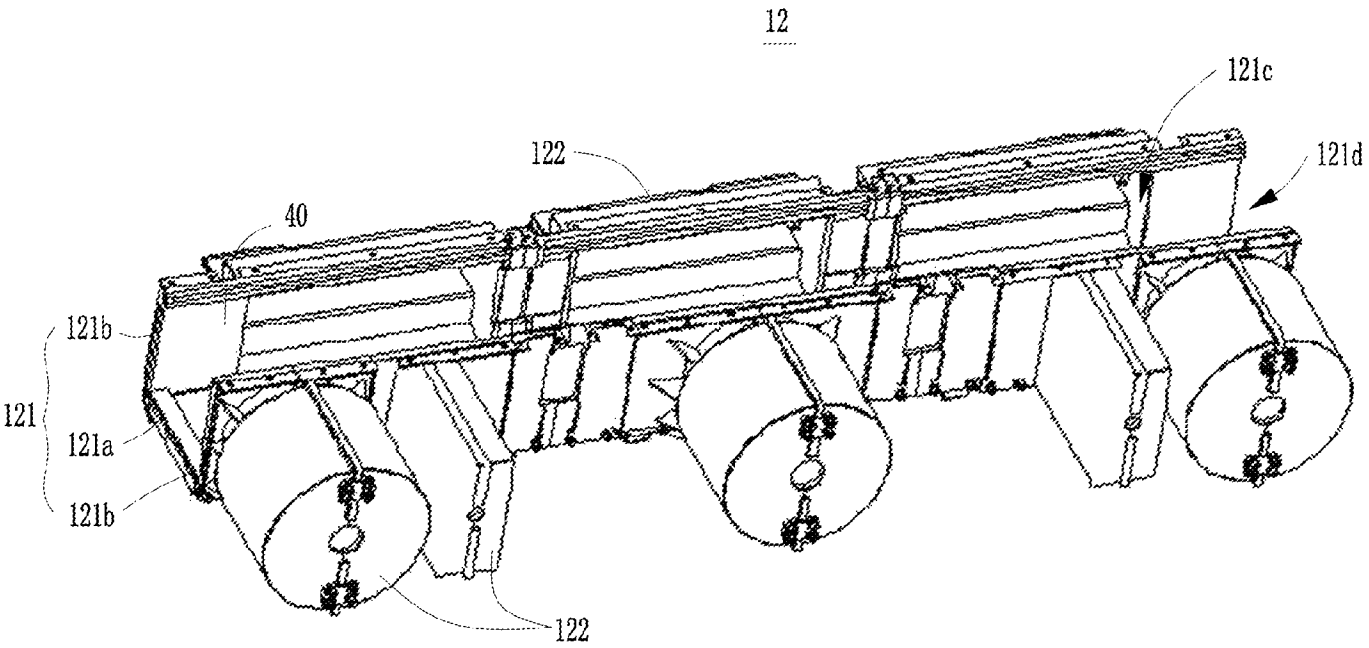
FIG. 3 is a schematic view showing a structure of a bottom cover according to an embodiment of the present disclosure.

As shown in FIG. 2 and FIG. 3, the bottom cover 12 includes a main shielding body 121 and an auxiliary shielding body 122 provided on the main shielding body 121. The main shielding body 121 preferably includes a bottom plate 121*a* and two side plates 121*b* provided on both sides of the bottom plate 121*a*, such that the main shielding body 121 has a U-shaped cross section and is formed with an upper opening 121*c* and two side openings 121*d*. The auxiliary shielding body 122 is located on two side plates 121*b* of the main shielding body 121, particularly on outer wall surfaces of the two side plates 121*b*. The auxiliary shielding body 122 may preferably be one or more of a group consisting of: a hollow cylindrical cover, a hollow rectangular cover and a square tube. The auxiliary shielding body 122 is mainly used for receiving a high voltage controller, cables, etc. of the radiation source machine. The bottom cover 12 with the above structure can meet a shielding requirement for the radiation source machine, can reduce overall size of the shield cover for a radiation source machine 1 and thus occupation space thereof, and have a wide application range.

Figure 4:
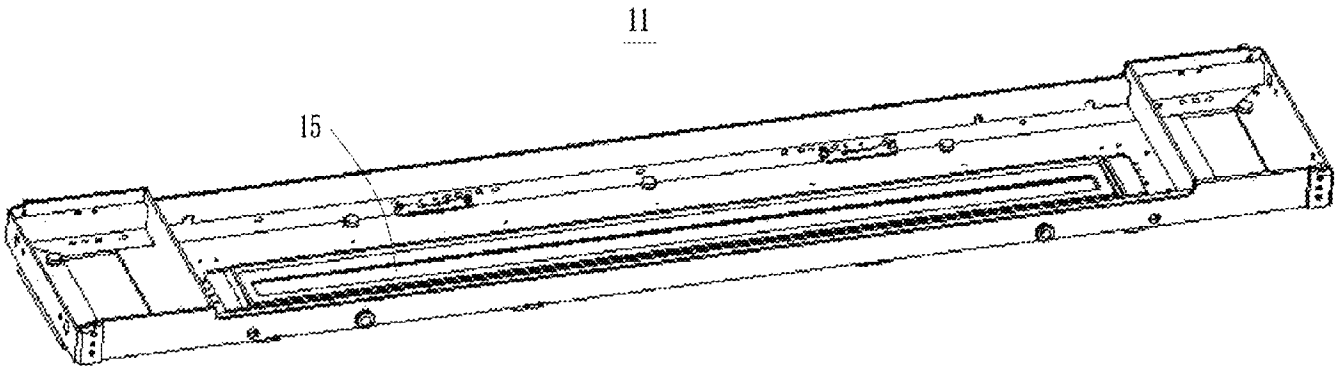
FIG. 4 is a schematic view showing a structure of a top cover according to an embodiment of the present disclosure.

As shown in FIGS. 2 and 4, the top cover 11 is of a rectangular frame structure with an opening on one side, and the ray exit 15 is located on the top cover 11. A length of the top cover 11 corresponds to that of the bottom cover 12. The side of the top cover 11 having the opening is connected to the upper opening 121*c* of the bottom cover 12 to form the frame body 10 with an internal chamber, which is the receiving chamber 13 for receiving the radiation source machine, and the two side openings 121*d* of the bottom cover 12 are the end openings 14 of the frame body 10. In order to ensure the strength of the frame body 10, a reinforced beam 16 is connected between the top cover 11 and the bottom cover 12.

Figure 5:
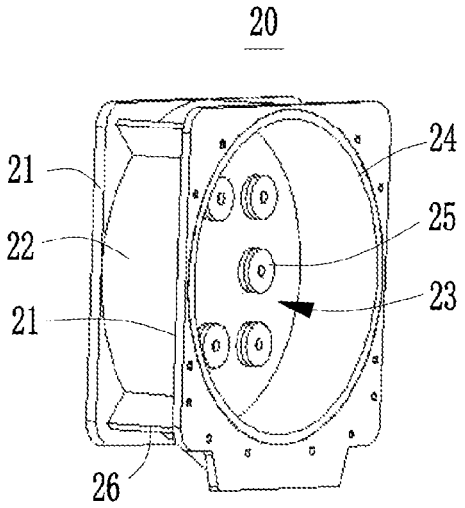
FIG. 5 is a schematic view showing a structure of an end cover according to an embodiment of the present disclosure.

As shown in FIG. 5, the end cover 20 includes two end plates 21 arranged in parallel and an annular side plate 22 connected between the two end plates 21, and the sealed chamber 23 is formed by the two end plates 21 and the annular side plate 22 together. The end plate 21 closer to the end opening 14 is provided with a through hole 24, for communicating with the receiving chamber 13. In order to ensure strength of the end cover 20, a reinforced rib 26 is connected between the annular side plate 22 and the two end plates 21.

In the embodiment, the frame body 10 includes two end openings 14. Therefore, one end cover 20 is provided at each end opening 14, and the end cover 20 is movably connected to the frame body 10 by the connecting member 30.

Figure 6:
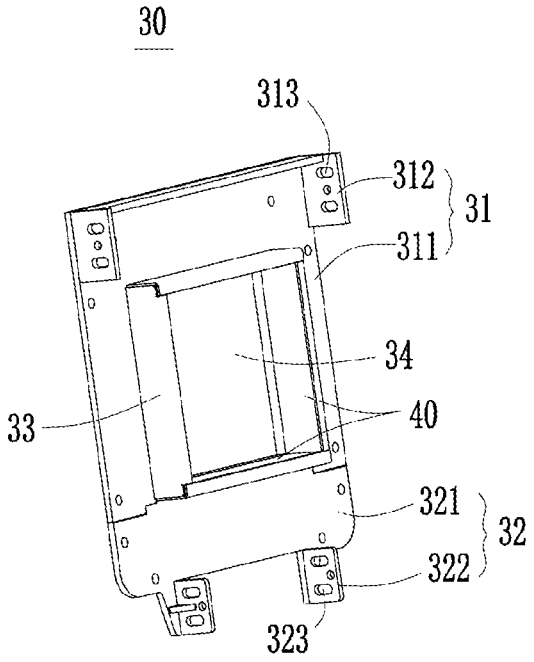
FIG. 6 is a schematic view showing a structure of a connecting member according to an embodiment of the present disclosure.

In an optional embodiment, as shown in FIG. 1 and FIG. 6, the connecting member 30 includes a first connecting member 31 and a second connecting member 32. A side of the first connecting member 31 is fixedly connected to the end cover 20 and the other side thereof is movably connected to the frame body 10. A side of the second connecting member 32 is fixedly connected to the end cover 20 and the other side thereof is movably connected to the frame body 10. The first connecting member 31 and the second connecting member 32 are arranged to mate with each other to form an opening 34. Since the radiation source machine has a dimension of cross section at two ends larger than at its middle portion, the connecting member 30 is designed as a separated structure consisting of the first connecting member 31 and the second connecting member 32, so that the radiation source machine can smoothly enter into the sealed chamber 23 of the end cover 20 through the opening 34 of the connecting member 30 and meanwhile the shielding effect of the shield cover for a radiation source machine can be ensured.

Specifically, as shown in FIG. 1, FIG. 2, FIG. 6 and FIG. 7, the first connecting member 31 includes a first mounting plate 311 and a first connecting tab 312 located on the first mounting plate 311. The first mounting plate 311 is formed with a hole penetrating through the first mounting plate 311, so that the first mounting plate 311 can be connected to the end plate 21 of the corresponding end cover 20 by a fastener. The first connecting tab 312 is formed with a first hole 313 and the top cover 11 is formed with a second hole 123 corresponding to the first hole 313, wherein the first hole 313 is formed into a strip-shaped hole. A connector 314, which may be a fastening screw, is disposed in the first hole 313 and the second hole 123 so that the first connecting member 31 is movably connected to the frame body 10. As a result, a requirement that a side of the first connecting member 31 is fixedly connected to the end cover member 20 and the other side thereof is movably connected to the frame body 10 is satisfied.

As shown in FIG. 1, FIG. 2, and FIG. 6 to FIG. 8, the second connecting member 31 includes a second mounting plate 321 and a second connecting tab 312 located on the second mounting plate 321. The second mounting plate 321 can be connected to the end plate 21 of the corresponding end cover 20 by a fastener. The second connecting tab 322 is formed with a third hole 323 and the bottom cover 12 is formed with a fourth hole 124 corresponding to the third hole 323, wherein the third hole 323 is formed into a strip-shaped hole. A connector 324, which can be a fastening screw, is disposed in the third hole 323 and the fourth hole 124, so that the second connecting member 32 is movably connected to the frame body 10. As a result, a requirement that a side of the second connecting member 32 is fixedly connected to the end cover member 20 and the other side thereof is movably connected to the frame body 10 is satisfied. Meanwhile, the second mounting plate 321 of the second connecting member 32 is mated and connected with the first mounting plate 311 of the first connecting member 31 to form the opening 34 of the connecting member 30, for communicating with the receiving chamber 13 of the frame body 10 and the sealed chamber 23 of the end cover 20.

Therefore, during use of the shield cover for a radiation source machine of the embodiments of the present disclosure, the radiation source machine is received in the receiving chamber 13 of the frame body 10, with two ends extending into corresponding sealed chambers 23 of the end covers 20 through the openings of the connecting members 30. The rays emitted from the radiation source machine can only be emitted out through the ray exit 15 on the top cover 11 to scan the object under detection, and the remaining rays will be shielded by the shield cover for a radiation source machine 1. Thus, the shield cover of the present disclosure can be effectively shield the useless rays generated by the radiation source machine, avoiding the human body from being damaged.

Further, by changing a relative position of the connecting member 30 to the frame body 10 and thereby changing a relative position of the end cover 20 to the frame body 10, a distance of the end cover 20 from the end opening 14 can be changed such that an inner end surface of the end cover 20 can just lie against an end surface of the radiation source machine. Thus, a position of the radiation source machine and thus a horizontal play of the radiation source machine can be limited, to meet a requirement on the detection of the object under detection.

In order to better limit the horizontal play of the radiation source machine, as shown in FIG. 1 and FIG. 5, the end cover 20 is provided with an auxiliary positioning member 25. An end of the auxiliary positioning member 25 is provided to extend into the sealed chamber 23 and is able to abut the end surface of the radiation source machine. In an embodiment, the auxiliary positioning member 25 is formed as a rod that is threadedly connected to the end cover 20. Since the end face of the radiation source machine can withstand a pressing force and cannot withstand a pulling force, with such a shielding and adjusting manner, the radiation source machine itself will not be damaged.

It can be understood that the frame body 10 is not limited to the form in which the top cover 11 is connected with the bottom cover 12, and may also be in a form in which several covers are connected, for example, in a form in which one bottom cover 12 is connected with two top covers 11, as long as that a requirement of receiving the radiation source machine and effectively shielding the radiation source machine can be satisfied without damaging the radiation source machine itself.

Further, the bottom cover 12 is not limited to consisting of the main shielding body 121 and the auxiliary shielding body 122 mated with each other. In the case that the space is sufficiently large, it is possible for the bottom cover 12 to merely include a single main shielding body 121, and to place the radiation source machine and all the components, such as the high voltage controller, of the radiation source machine within the main shielding body 121 for shielding, without the need of providing the auxiliary shielding body 122.

Meanwhile, the first hole 313 is not limited to a strip-shaped hole. In an embodiment, the second hole 123 may be designed as a strip-shaped hole, or both of the first hole 313 and the second hole 123 may be designed as strip-shaped holes. The third hole 323 is not limited to a strip-shaped hole. In an embodiment, the fourth hole 124 may be designed as a strip-shaped hole, or both of the third hole 323 and the fourth hole 124 may be designed as strip-shaped holes. These embodiment are all possible, as long as that the first connecting member 31 is movably connected to the top cover 11 of the frame body 10 and the second connecting member 32 is movably connected to the bottom cover 12 of the frame body 10 so that the end cover 20 can move relative to the frame body 10 to adjust the distance of the end cover 20 from the end opening 14.

Figure 7:
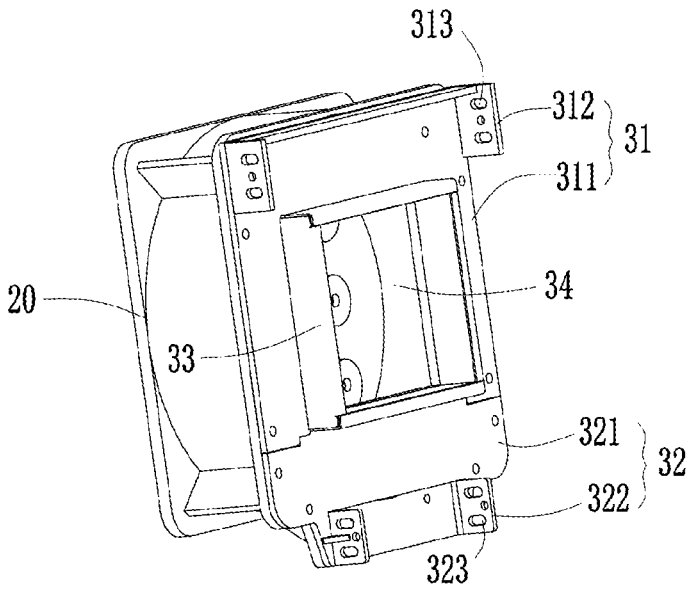
FIG. 7 is a schematic view showing a structure of a connecting member mounted on an end cover according to an embodiment of the present disclosure.
Figure 8:
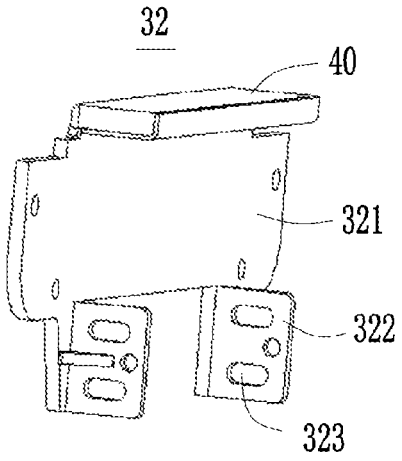
FIG. 8 is a schematic view showing a structure of a second connecting member according to an embodiment of the present disclosure.

Since the connecting member 30 needs to be moved relative to the frame body 10 to adjust the distance of the end cover 20 from the end opening 14, as an optional embodiment, as shown in FIG. 1 and FIG. 6, an enclosing member 33 extending into the receiving chamber 13 is provided on the connecting member 30 surrounding the opening 34, to prevent the rays from the radiation source machine from leaking when the connecting member 30 is moved relative to the frame body 10. An outer wall surface of the enclosing member 33 and an inner wall surface of the receiving chamber 13 are always kept overlapping with each other during the movement of connecting member 30 with a gap remained therebetween. The overlapping length between the outer wall surface of the enclosing member 33 and the inner wall surface of the receiving chamber 13 may be 15 to 20 times the length of the gap between the outer wall surface of the enclosing member 33 and the inner wall surface of the receiving chamber 13. As a result, the connecting member 30 is easily moved relative to the frame body 10, and when the connecting member 30 is moved relative to the frame body 10, the rays will not leak from the gap between the frame body 10 and the connecting member 30, thereby ensuring a shielding effect of the shield cover 1 for the rays of the radiation source machine. Meanwhile, when the connecting member 30 is moved relative to the frame body 10, the enclosing member 33 can play a corresponding guiding role. As shown in FIG. 6 to FIG. 8, the enclosing member 33 is formed by two separated parts respectively provided on the first connecting member 31 and the second connecting member 32. When the first connecting member 31 and the second connecting member 32 are mated with each other, the enclosing member 33 is formed, which facilitates an installation of the radiation source machine. In one embodiment, a length of the enclosing member 33 extending into the receiving chamber 13 is larger than that of the strip-shaped hole to avoid that the enclosing member 33 is moved out of the receiving chamber 13 due to an over-adjustment.

In the shield cover for a radiation source machine 1 of the embodiment of the present disclosure, the frame body 10, the end cover 20 and the connecting member 30 all can be made of a radiation-proof material, to meet shielding requirements for the rays of the radiation source machine.

As a preferred embodiment, the frame body 10, the end cover 20 and the connecting member 30 may be made of a metal material or the like, and each of the frame body 10, the end cover 20 and the enclosing member 33 is provided with an anti-radiation plate, such as a lead plate on the respective wall surface, which can also meet an anti-radiation requirement for the rays of the radiation source machine, and meanwhile can ensure strength of the shield cover for a radiation source machine 1 with a lower cost.

Figure 9:
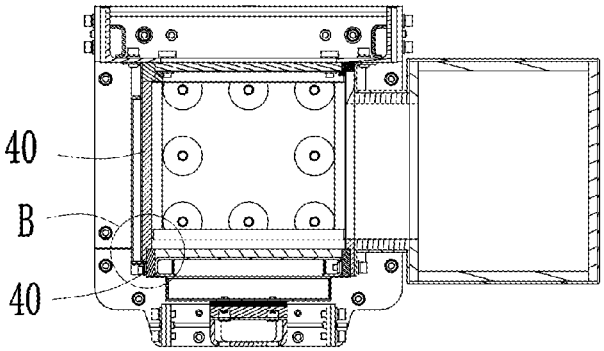
FIG. 9 is a cross-sectional view of FIG. 1 taken along line A-A.
Figure 10:
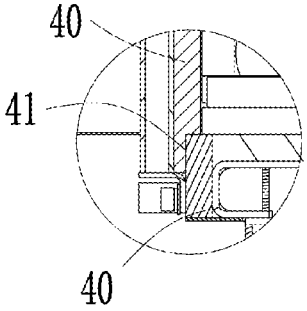
FIG. 10 is an enlarged view of a portion B in FIG. 9.

As a preferred embodiment, the anti-radiation plate is provided on an inner wall surface of each of the frame body 10, the end cover 20 and the enclosing member 33. As strength of the anti-radiation plate, such as the lead plate, is not high, and a surface of the plate cannot be ensured to be completely flat, when adjacent ends of two adjacent anti-radiation plates are directly engaged with each other, it is impossible to ensure a complete closure and there is a gap therebetween. As shown in FIG. 9 and FIG. 10, where the bottom cover 12 of the frame body 10 is taken as an example, an anti-radiation plate 40 on the bottom plate 121*a* and an anti-radiation plate 40 on the side plate 121*b* constitute two adjacent anti-radiation plates 40, and two ends each of which is from one of the two adjacent anti-radiation plates 40, contacting with and abutting each other are adjacent ends of the two adjacent anti-radiation plates 40. If the adjacent ends of the two adjacent anti-radiation plates 40 are contact with each other directly, the rays will emit out directly and leak from the gap between the two adjacent anti-radiation plates 40. Therefore, the adjacent ends of the two adjacent anti-radiation plates 40 are arranged to be in an overlapping connection with each other, to prevent leakage of the rays from the radiation source machine. In one embodiment, one of the adjacent ends is formed with a stepped portion 41, and the other of the adjacent ends is formed to mate with the stepped surface 41 such that the adjacent ends are in the overlapping connection with each other.

Since the adjacent ends of the two adjacent anti-radiation plates 40 are in the overlapping connection with each other, even if there is a gap between the adjacent ends, the rays cannot emit out directly and leak from the gap, further improving a shielding effect of the shield cover for a radiation source machine 1. In this embodiment, the two adjacent anti-radiation plates 40 on the bottom cover 12 are only described as an example, and the overlapping connection between the adjacent ends of two adjacent anti-radiation plates 40 is not limited to the bottom cover 12. For the shield cover for a radiation source machine 1, it is possible for the anti-radiation plates 40 provided on all the members, for example, the top cover 11, the end cover 20, and the enclosing member 33, etc., to connect adjacent ends by the overlapping manner according to an anti-radiation requirement, to improve the shielding effect of the shield cover for a radiation source machine 1.

During use of the shield cover for a radiation source machine 1 provided by the embodiment of the present disclosure, the radiation source machine is placed in the receiving chamber 13, and the top cover 11, the bottom cover 12 and the end cover 20 of the frame body 10 are connected by the connecting member 30. A distance of the end cover 20 from the end opening 14 is changed by changing a relative position of the connecting member 30 to the frame body 10. After the relative position is adjusted and determined, the connector 314 in the first hole 313 and the second hole 123 and the connector 324 in the third hole 323 and the fourth hole 124 are tightened to lock the relative position of the end cover 20 to the frame body 10, so that the inner end surface of the end cover 20 and the end surface of the radiation source machine just lie against each other and the position of the radiation source machine is limited. A positioning pin 315 can be punched on the spot to ensure a repeated positioning accuracy when re-installing. Meanwhile, the auxiliary positioning member 25 on the end cover 20 is adjusted to abut the end face of the radiation source machine to better limit the horizontal play of the radiation source machine. The shield cover for a radiation source machine 1 provided by the embodiments of the present disclosure can effectively shield the useless rays generated by the radiation source machine to prevent the human body from being damaged, without damaging the radiation source machine itself, and is easy to spread and use.

Figure 11:
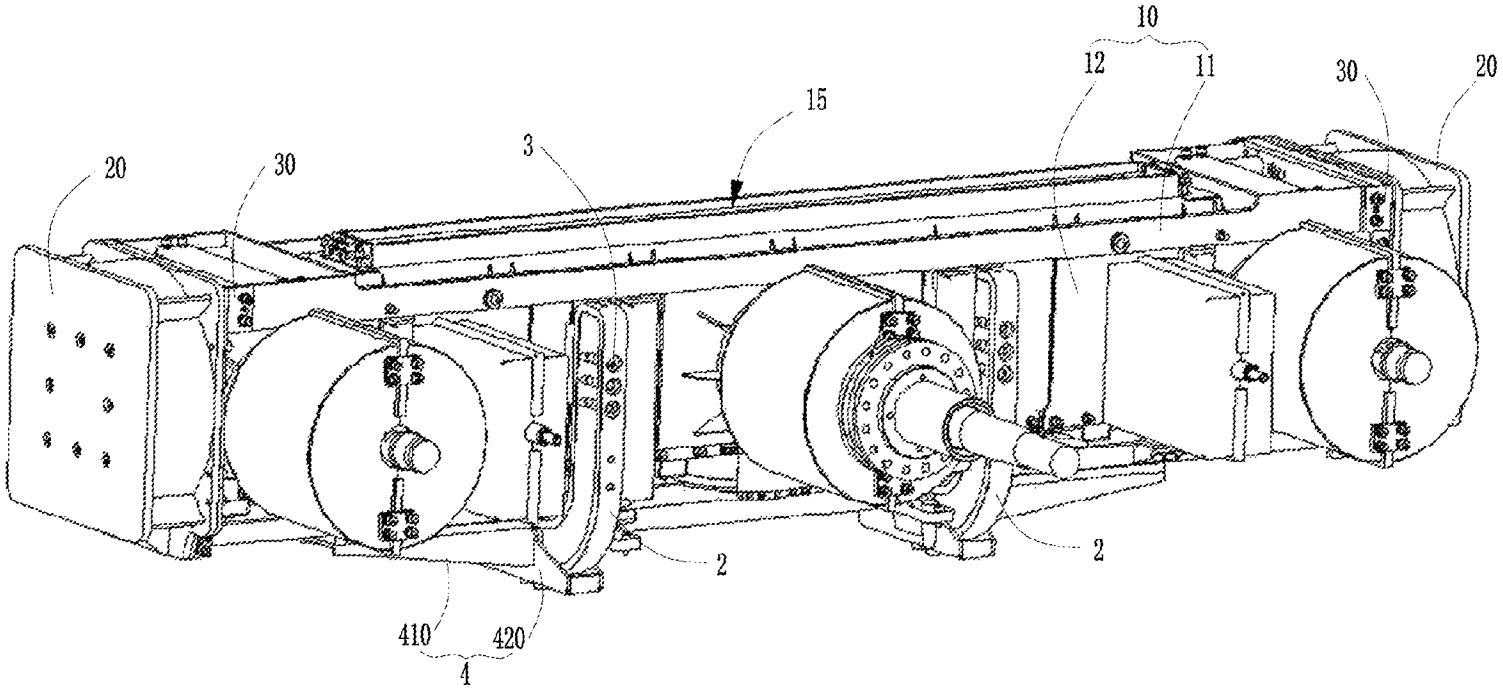
FIG. 11 is a schematic view showing a structure of a security inspection apparatus according to an embodiment of the present disclosure.

As shown in FIG. 11, a security inspection apparatus provided according to an embodiment of the present disclosure includes: the shield cover for a radiation source machine 1 of any of the above embodiments, the radiation source machine and the U-shaped arm 2. The radiation source machine is disposed in the receiving chamber 13. There are two U-shaped arms 2 symmetrically provided on an outside of the frame body 10 and connected to the radiation source machine to make the radiation source machine in a suspended state in the receiving chamber 13.

Specifically, connecting holes are correspondingly provided on the outer wall of the frame body 10 and the U-shaped arm 2. A connecting component 3 is connected to the radiation source machine through the corresponding connecting holes on the U-shaped arm 2 and the frame body 10, so that the radiation source machine is in the suspended state in the receiving chamber 13. Preferably, the suspended state means that side wall surfaces of the radiation source machine are not in contact with wall surfaces of the receiving chamber 13.

Figure 12:
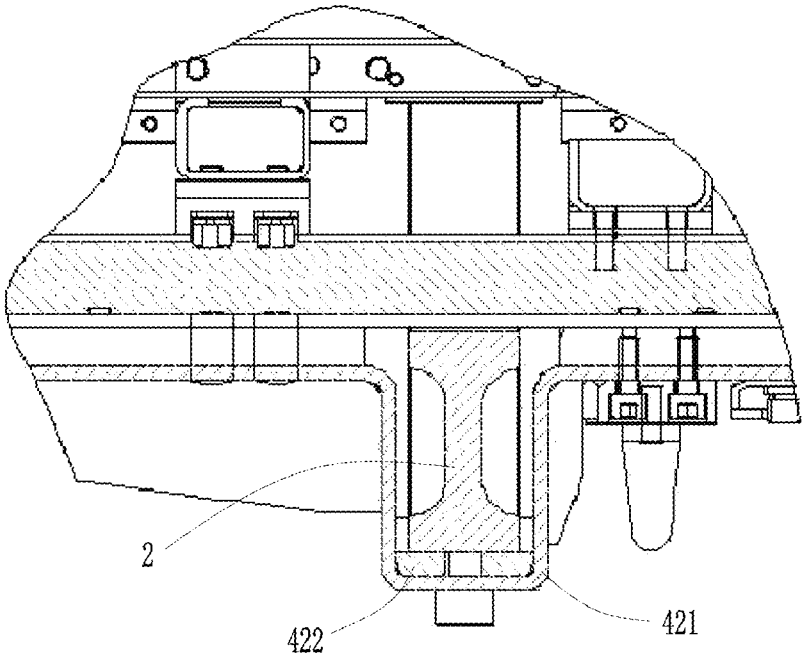
FIG. 12 is a partial cross-sectional view showing a U-shaped arm mating with a fixing seat according to an embodiment of the present disclosure.

In an optional embodiment, as shown in FIG. 11 and FIG. 12, the frame body 10 is engaged with the U-shaped arm 2, with the frame body 10 received in a U-shaped opening of the U-shaped arm 2, and a fixing seat 4 is provided on a position of the frame body 10 corresponding to the U-shaped arm 2. The U-shaped arm 2 is connected to the frame body 10 by the fixing seat 4, and the fixing seat 4 includes a frame body connecting end 410 and a U-shaped arm connecting end 420. The frame body connecting end 410 is connected to the frame body 10, and the U-shaped arm connecting end 420 has a U-shaped groove 421 with a shape matching with that of a bottom of the U-shaped arm 2. The bottom of the U-shaped arm 2 is located in the U-shaped groove 421 and is fixedly connected with the fixing seat 4 by a fastener. An adjusting pad 422 is provided between the bottom of the U-shaped arm 2 and the fixing seat 4, and the adjusting pad 422 is preferably located within the U-shaped groove 421. The adjusting pad 422 can be increased or decreased, that is, a thickness of the adjusting pad 422 can be changed to compensate an error generated in the machining, so that the U-shaped arm 2 can only bear a longitudinal force, does not bear a horizontal thrust and torsional force, to satisfy a force requirement for the U-shaped arm 2.

In the security inspection apparatus provided by the embodiments of the present disclosure, the rays emitted by the radiation source machine can only emit out through the ray exit 15 on the frame body 10 to scan the object under detection, and the remaining rays will be shielded by the shield cover for a radiation source machine 1. The useless rays generated by the radiation source machine can effectively shielded to avoid the human body from being damaged. By changing the relative position of the connecting member 30 to the frame body 10, the distance of the end cover 20 from the end opening 14 can be changed, such that the inner end surface of the end cover 20 can just lie against the end surface of the radiation source machine, to limit the horizontal position of the radiation source machine, meeting a detecting requirement for the object under detection. Moreover, the radiation source machine is in a suspended state in the receiving chamber 13, which does not cause damage to the radiation source machine itself and a force requirement for the radiation source machine is satisfied.

Figure 13:
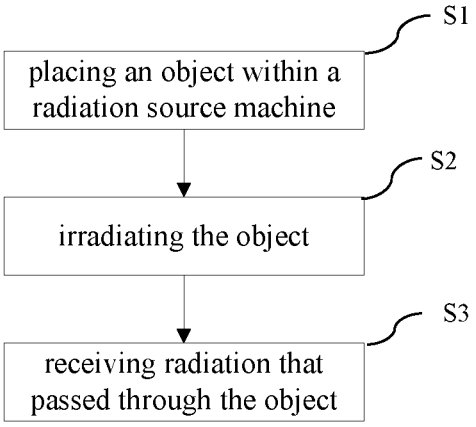
FIG. 13 shows a flowchart of a method of radiating an object by use of a radiation source machine of the present disclosure.

FIG. 13 shows a flowchart of a method of radiating an object by use of a radiation source machine of the present disclosure. The object may be a person with cancer, objects to eradicate bacteria. The method comprises placing an object within a radiation source machine (Step S1); irradiating the object (Step S2); and receiving radiation that passed through the object (Step S3).

Although the present disclosure has been described with reference to the preferred embodiments thereof, various modifications may be made thereto and components may be replaced with equivalents without departing from the scope of the present disclosure. In particular, technical features mentioned in the various embodiments can be combined in any manner as long as there is no structural conflict. The present disclosure is not limited to the specific embodiments disclosed herein, but includes all technical solutions falling within the scope of the claims.

What is claimed is:

1. A shield cover for a radiation source machine, wherein, comprising:

a frame body provided with a receiving chamber for receiving the radiation source machine, an end opening and an ray exit through which rays are emitted out from the radiation source machine;

an end cover disposed at the end opening of the frame body and provided with a sealed chamber communicating with the receiving chamber; and a connecting member disposed between the end cover and the frame body and provided with an opening for communicating the sealed chamber of the end cover with the receiving chamber of the frame body, and the end cover being movably connected to the frame body by the connecting member such that a distance of the end cover from the end opening of the frame body is adjustable.

2. The shield cover for a radiation source machine of claim 1, wherein, the connecting member comprises a first connecting member and a second connecting member, a side of the first connecting member is fixedly connected to the end cover and the other side of the first connecting member is movably connected to the frame body, and a side of the second connecting member is fixedly connected to the end cover and the other side of the second connecting member is movably connected to the frame body, wherein the first connecting member and the second connecting member are arranged to mate with each other to form the opening.

3. The shield cover for a radiation source machine of claim 2, wherein, the first connecting member and the frame body are respectively provided with a first hole and a second hole corresponding with each other, wherein at least one of the first hole and the second hole is formed into a strip-shaped hole, and a first connector is disposed within the first hole and the second hole to movably connect the first connecting member to the frame body, and the second connecting member and the frame body are respectively provided with a third hole and a fourth hole corresponding with each other, wherein at least one of the third hole and the fourth hole is formed into a strip-shaped hole, and a second connector is disposed within the third hole and the fourth hole to movably connect the second connecting member to the frame body.

4. The shield cover for a radiation source machine of claim 1, wherein, the connecting member is provided with an enclosing member surrounding the opening and extending into the receiving chamber, and an outer wall surface of the enclosing member and an inner wall surface of the receiving chamber are kept overlapping with each other with a gap remained therebetween.

5. The shield cover for a radiation source machine of claim 4, wherein, the frame body, the end cover, and the enclosing member are provided with anti-radiation plates on their respective wall surfaces.

6. The shield cover for a radiation source machine of claim 5, wherein, the anti-radiation plates are provided on respective inner wall surfaces of the frame body, the end cover and the enclosing member, and two adjacent ends of two adjacent anti-radiation plates are in an overlapping connection with each other.

7. The shield cover for a radiation source machine of claim 6, wherein, one of the two adjacent ends is formed with a stepped portion, and the other of the two adjacent ends is formed to mate with the stepped portion such that the two adjacent ends are in the overlapping connection with each other.

8. The shield cover for a radiation source machine of claim 1, wherein, the frame body is formed into a separated structure and includes a top cover and a bottom cover in connection with each other.

9. The shield cover for a radiation source machine of claim 1, wherein, the end cover is provided with an auxiliary positioning member, an end of which is formed to extend into the sealed chamber so as to be capable of abutting the radiation source machine and limiting a horizontal play of the radiation source machine.

10. The shield cover for a radiation source machine of claim 9, wherein, the auxiliary positioning member is formed as a rod threadedly connected to the end cover.

11. A security inspection apparatus, wherein, comprising:

a shield cover for a radiation source machine, comprising:

a frame body provided with a receiving chamber for receiving the radiation source machine, an end opening and an ray exit through which rays are emitted out from the radiation source machine;

an end cover disposed at the end opening of the frame body and provided with a sealed chamber communicating with the receiving chamber; and a connecting member disposed between the end cover and the frame body and provided with an opening for communicating the sealed chamber of the end cover with the receiving chamber of the frame body, and the end cover being movably connected to the frame body by the connecting member such that a distance of the end cover from the end opening of the frame body is adjustable, the radiation source machine disposed in the receiving chamber; and a U-shaped arm provided on an outside of the frame body and connected to the radiation source machine to make the radiation source machine in a suspended state in the receiving chamber.

12. The security inspection apparatus of claim 11, wherein, the U-shaped arm is engaged with the frame body with the frame body received in an U-shaped opening of the U-shaped arm, and the frame body is provided with a fixing seat at a position corresponding to the U-shaped arm, through which the U-shaped arm is connected to the frame body, wherein an adjusting pad is provided between a bottom of the U-shaped arm and the fixing seat.

13. The security inspection apparatus of claim 11, wherein, the connecting member comprises a first connecting member and a second connecting member, a side of the first connecting member is fixedly connected to the end cover and the other side of the first connecting member is movably connected to the frame body, and a side of the second connecting member is fixedly connected to the end cover and the other side of the second connecting member is movably connected to the frame body, wherein the first connecting member and the second connecting member are arranged to mate with each other to form the opening.

14. The security inspection apparatus of claim 13, wherein, the first connecting member and the frame body are respectively provided with a first hole and a second hole corresponding with each other, wherein at least one of the first hole and the second hole is formed into a strip-shaped hole, and a first connector is disposed within the first hole and the second hole to movably connect the first connecting member to the frame body, and the second connecting member and the frame body are respectively provided with a third hole and a fourth hole corresponding with each other, wherein at least one of the third hole and the fourth hole is formed into a strip-shaped hole, and a second connector is disposed within the third hole and the fourth hole to movably connect the second connecting member to the frame body.

15. The security inspection apparatus of claim 11, wherein, the connecting member is provided with an enclosing member surrounding the opening and extending into the receiving chamber, and an outer wall surface of the enclosing member and an inner wall surface of the receiving chamber are kept overlapping with each other with a gap remained therebetween.

16. The security inspection apparatus of claim 15, wherein, the frame body, the end cover, and the enclosing member are provided with anti-radiation plates on their respective wall surfaces.

17. The security inspection apparatus of claim 16, wherein, the anti-radiation plates are provided on respective inner wall surfaces of the frame body, the end cover and the enclosing member, and two adjacent ends of two adjacent anti-radiation plates are in an overlapping connection with each other.

18. The security inspection apparatus of claim 17, wherein, one of the two adjacent ends is formed with a stepped portion, and the other of the two adjacent ends is formed to mate with the stepped portion such that the two adjacent ends are in the overlapping connection with each other.

19. A method of radiating an object, comprising:

placing an object within a radiation source machine; the radiation source machine have a shield cover comprising:

a frame body provided with a receiving chamber for receiving the radiation source machine, an end opening and an ray exit through which rays are emitted out from the radiation source machine;

an end cover disposed at the end opening of the frame body and provided with a sealed chamber communicating with the receiving chamber; and a connecting member disposed between the end cover and the frame body and provided with an opening for communicating the sealed chamber of the end cover with the receiving chamber of the frame body, and the end cover being movably connected to the frame body by the connecting member such that a distance of the end cover from the end opening of the frame body is adjustable, and irradiating the object.

20. The method of claim 19, further comprising receiving radiation that passed through the object.

* * * * *